US005934512A

United States Patent [19]

Lampe et al.

[11] Patent Number: 5,934,512

[45] Date of Patent: Aug. 10, 1999

[54] DISPENSING VALVE CLOSURE WITH INNER SEAL

[75] Inventors: William H. Lampe, Marietta; Inocencio Martinez, Kennesaw; John F. Kaiser, Snellville, all of Ga.; John M. Hess, Waukesha, Wis.; Jeffrey T. Randall, Oconomowoc, Wis.; Christopher J. Wood, Wauwatosa, Wis.; Jon K. Plotkin, Powder Springs, Ga.

[73] Assignees: The Coca-Cola Company, Atlanta, Ga.; Aptar Group, Inc., Crystal Lake, Ill.

[21] Appl. No.: 08/833,774

[22] Filed: Apr. 9, 1997

[51] Int. Cl.[6] ..... B67D 5/32

[52] U.S. Cl. ..... 222/108; 222/153.06; 222/494; 222/556

[58] Field of Search ..... 222/153.06, 494, 222/556, 108, 571; 215/232

[56] References Cited

U.S. PATENT DOCUMENTS

| | | | |
|---|---|---|---|
| 4,664,295 | 5/1987 | Iida | 222/571 |
| 4,676,389 | 6/1987 | Bullock | 215/232 |
| 4,872,571 | 10/1989 | Crecelius et al. . | |
| 4,993,606 | 2/1991 | Bolen, Jr. et al. . | |
| 5,115,950 | 5/1992 | Rohr . | |
| 5,145,083 | 9/1992 | Takahashi | 215/232 |
| 5,213,236 | 5/1993 | Brown et al. . | |
| 5,271,531 | 12/1993 | Rohr et al. . | |
| 5,307,955 | 5/1994 | Viegas . | |
| 5,390,805 | 2/1995 | Bilani et al. | 222/490 |
| 5,551,608 | 9/1996 | Moore et al. . | |
| 5,632,420 | 5/1997 | Lohrman et al. . | |
| 5,794,803 | 8/1998 | Sprick | 222/571 |

FOREIGN PATENT DOCUMENTS

| | | |
|---|---|---|
| 0 32 3370 | 7/1989 | European Pat. Off. . |
| 1228265 | 8/1960 | France . |
| 172438 | 9/1952 | Germany . |
| 0 184 447 | 5/1936 | Switzerland . |

OTHER PUBLICATIONS

Sample of closure marketed on a Wesson(™) Sitr–Fry Oil bottle, on market sometime in the 1st or 2nd quarter of 1995.

*Primary Examiner*—Philippe Derakshani
*Attorney, Agent, or Firm*—Dennis W. Braswell

[57] ABSTRACT

A dispensing valve closure (10) is provided which includes a closure body (12) and a cap (14). A self-sealing dispensing valve (16) is disposed within the closure (10) and is held in place with a retaining ring (18). Drain holes (50–56) allow drainage of any fluids built up under the cap (14).

24 Claims, 6 Drawing Sheets

DISPENSING VALVE CLOSURE WITH INNER SEAL

TECHNICAL FIELD OF THE INVENTION

This invention relates generally to closures, and more particularly to a dispensing valve closure with an inner seal.

BACKGROUND OF THE INVENTION

A myriad of packages exist for containing materials that flow (generally referred to herein as "fluids"), such as beverages, soaps, foods, powders and chemicals, among many others. These packages are filled with the fluids through openings, such as that provided at the finish area of bottles. These openings are then sealed for distribution of the packages. The sealing is generally done with a closure, of which there are a large number of different types.

In the beverage industry, closures used for many packages, including bottles, are generally of the screw-on type, and may be repeatedly removed and resealed. Recently, however, an increasing number of beverage closures include dispensing valves that allow the beverages to flow through the closure for consumption, without removal of the closure. The most widely used dispensing closure is the pull-push dispensing closure, similar to that used on many liquid dish-washing soap packages.

The pull-push closure, however, has significant drawbacks. For example, it requires the user to manually pull the spout open and closed. Also, if the user does not close the spout, the package will leak, since the spout has no valve to automatically reseal.

A self-closing dispensing valve has been developed for use with fluids other than those suitable for consumption, for example for use with liquid soaps and lotions. Such a self-closing valve is disclosed in U.S. Pat. No. 5,213,236, issued on May 25, 1993 to Brown et al., entitled "DISPENSING VALVE FOR PACKAGING." However, the packages and closures used in connection with such dispensing valves have not been designed for aseptic, hot fill, or other cold-filled preserved products.

Therefore, a need has arisen for a dispensing valve closure that is self-sealing (also referred to as self-closing), and that is suitable for use in the food and beverage industries.

SUMMARY OF THE INVENTION

In accordance with the teachings of the present invention, a self-sealing dispensing valve closure that accommodates an inner seal is provided which substantially reduces or eliminates disadvantages and problems associated with prior art dispensing valves. Also, methods of sealing bottles are provided.

In particular, a sealing and dispensing device for a package that contains a fluid is provided. A closure is provided which is shaped to engage with the package. Furthermore, an inner seal is provided which is operable to seal on a land area of the package. A self-sealing dispensing valve is disposed within the closure opposite the inner seal from the fluid.

This device is particularly suited to the food and beverage industry, and in particular for fluids such as isotonic or non-isotonic sports drinks. It should be understood that this illustration is exemplary only, and the present invention may be used with a wide range of foods, beverages, and other fluids, including teas, juices, fruit drinks, water, and flavored water, among many other fluids.

In a particular embodiment, the inner seal is an induction seal. With an induction seal, a hermetic, vacuum retaining seal can be provided for sealing the package and fluid. Such sealing is important in the food and beverage industry, so as to maintain product integrity, and eliminate the possibility of leakage in distribution.

Furthermore, in another embodiment, a closure is provided with drain holes to allow drainage of undesirable matter, such as water, that may collect under the cap. Also, methods of sealing a bottle are provided, which allow such undesirable matter to be drained from the closure. In a particular method, air blowing is used to allow drainage.

An important technical advantage of the present invention is the fact that the self-sealing dispensing valve is disposed in the closure of the present invention in such a manner as to accommodate an inner seal for sealing on the land area of a package.

BRIEF DESCRIPTION OF THE DRAWINGS

For a more complete understanding of the present invention and the advantages thereof, references now made to the following description taken in conjunction with the accompanying drawings in which like reference numbers indicate like features and wherein.

DETAILED DESCRIPTION OF THE INVENTION

Figure 1:
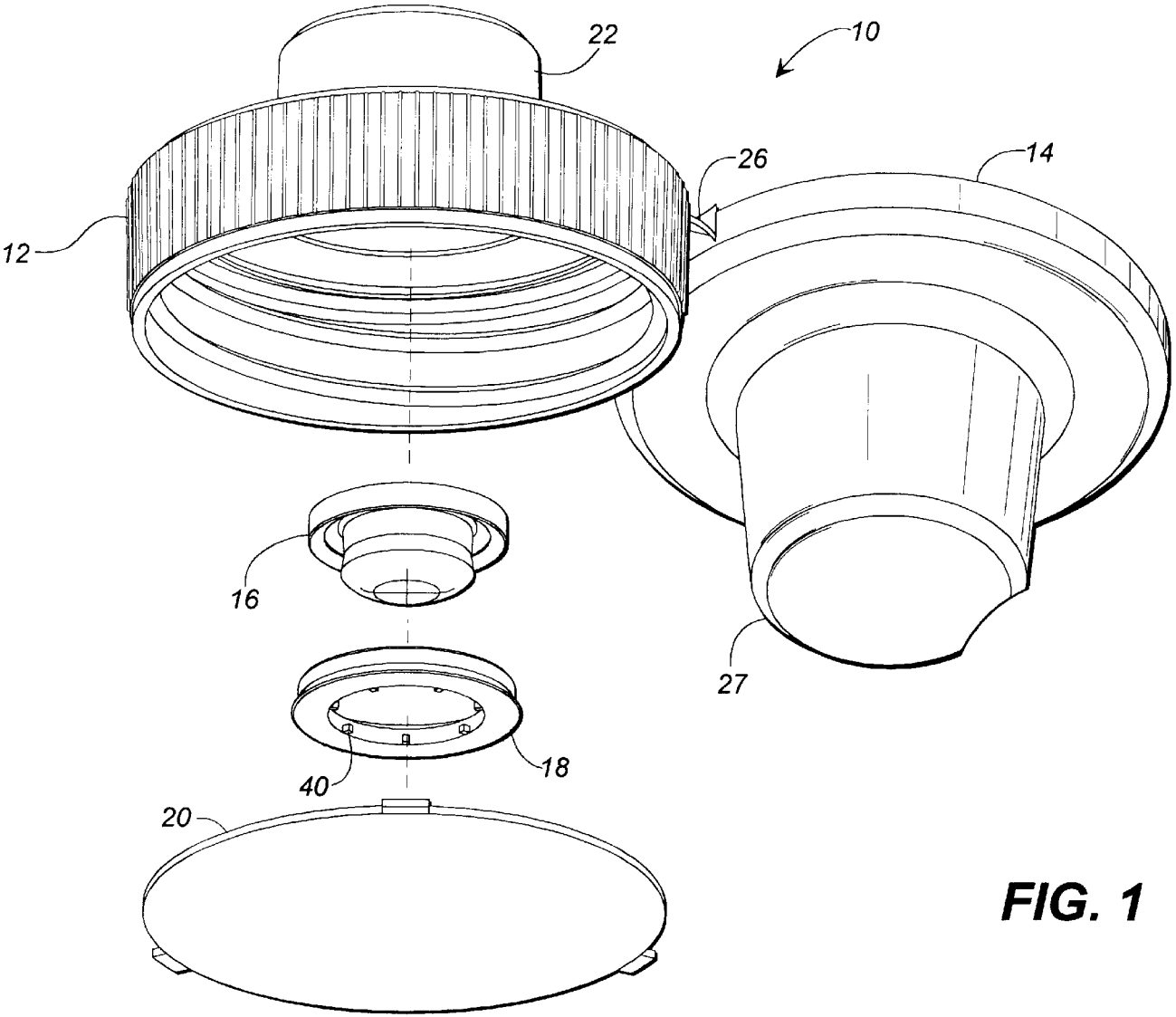
FIG. 1 illustrates an exploded view of a particular embodiment of a dispensing valve closure that accommodates an inner seal, according to the teachings of the present invention.

FIG. 1 illustrates an exploded view of a particular embodiment of a dispensing valve closure 10 according to the teachings of the present invention. As shown in FIG. 1, dispensing valve closure 10 includes a closure body (or shell) 12, a cap 14, a self-sealing dispensing valve 16, and a retaining ring (or cartridge) 18. Also shown is an inner seal 20, which, as will be discussed below, provides a seal to prevent the fluid from contacting the closure 10 or any of its components, for example during transportation and storage of shelf-stable packaged beverages, such as isotonic and non-isotonic sports drinks. Closure body 12, in the particular embodiment shown in FIG. 1, includes a raised boss structure 22.

Self-sealing dispensing valve 16 may be any suitable self-sealing dispensing valve. A particular example of a self-sealing dispensing valve that may be used is disclosed in U.S. Pat. No. 5,213,236, issued on May 25, 1993 to Brown et al., and entitled "DISPENSING VALVE FOR PACKAGING." That patent is herein incorporated by reference. The self-sealing dispensing valve may be formed from a resiliently flexible material, and in particular may be formed from a silicone rubber that is substantially inert, thus avoiding deleterious reaction with the food, beverage, or other fluid to be dispensed.

The self-sealing dispensing valve 16 allows fluid to be dispensed by increasing the pressure within the package, for example through squeezing of the package. Once the pressure is released, the valve 16 automatically seals, thus preventing leaking.

As will be discussed in detail below, self-sealing dispensing valve 16 is disposed within boss 22 and held in place by retaining ring 18 or other device, such as a cartridge. Prior to application of the closure 10 to the package to be sealed, the inner seal 20 is preferably placed within the closure body 12, proximate to retaining ring 18. The inner seal 20 seals the package on which closure 10 is placed, thereby preventing the fluid within the package from coming into contact with the dispensing valve closure 10 or any of its components, until the inner seal 20 is removed. In the food and beverage industries, it is often important that the fluid be hermetically sealed, to maintain the integrity of the fluid, for example to prevent the growth of micro-organisms in the fluid after filling.

The present invention accommodates the need to provide such a seal, and yet allows the use of a self-sealing dispensing valve. In particular, this is accomplished by disposing the self-sealing dispensing valve above the "land area" of the package finish, on which inner seal 20 forms its seal. A significant technical advantage of the present invention the accommodation of both an inner seal and a self-sealing dispensing valve, thereby allowing the use of self-sealing dispensing valves in industries such as the food and beverage industries, which often require shelf stable packaging.

Figure 2:
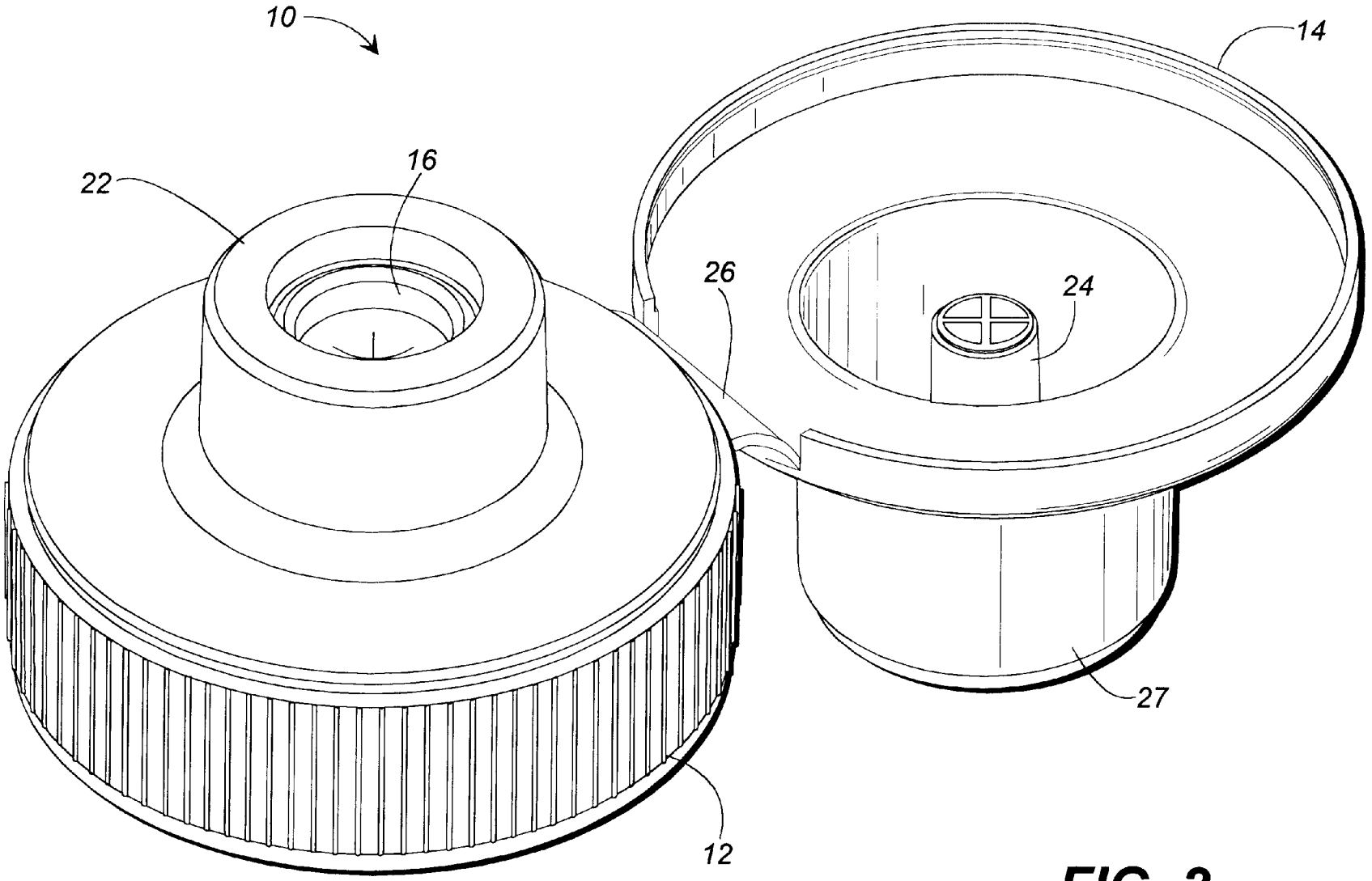
FIG. 2 illustrates an isometric top view of a particular embodiment of a dispensing valve closure according to the teachings of the present invention.

FIG. 2 illustrates an isometric top view of the dispensing valve closure shown in FIG. 1. As shown in FIG. 2, a protrusion 24 is provided within cap 14. Cap 14 provides a cover for dispensing valve 16 and boss structure 22. In the particular embodiment shown in FIG. 2, cap 14 is connected to closure body 12 with a hinge 26. The particular connection shown between cap 14 and closure body 12 is exemplary only, however, as thus connections other than hinges may be used. Furthermore, cap 14 need not be connected to closure body 12. For example, cap 14 can be separate from closure body 12, and may be snapped onto and off of closure body 12. Furthermore, cap 14 may be omitted altogether without departing from the intended scope of the present invention. As shown in FIG. 2, boss structure 22 is formed with a void to allow fluid to pass through the self sealing dispensing valve 16 and to the user.

As discussed above, cap 14 includes a protrusion 24. The protrusion 24 is provided to prevent self-sealing dispensing valve 16 from opening while the cap 14 is snapped onto closure body 12. Protrusion 24 is disposed within cap 14 and shaped so that, when cap 14 is closed, protrusion 24 is disposed within the cavity of the self sealing dispensing valve 16.

It should be understood that the particular shape of closure 10, closure body 12, cap 14, and boss structure 22 are exemplary only, and other structures may be used without departing from the intended scope of the present invention. The term "closure" is used herein to refer to any such structures, alone or in combination.

As shown in FIGS. 1 and 2, cap 14 includes flip lever 27, to facilitate flipping of the cap 14 on and off closure body 12. This flip lever 27 need not be included, or may be shaped differently than that shown in FIGS. 1 and 2. Similarly, as shown in FIGS. 1 and 2, boss structure 22 has a diameter less than that of closure body 12. However, they may be formed to have the same diameter, or shaped much differently than shown without departing from the intended scope of the present invention.

Figures 3, 4:
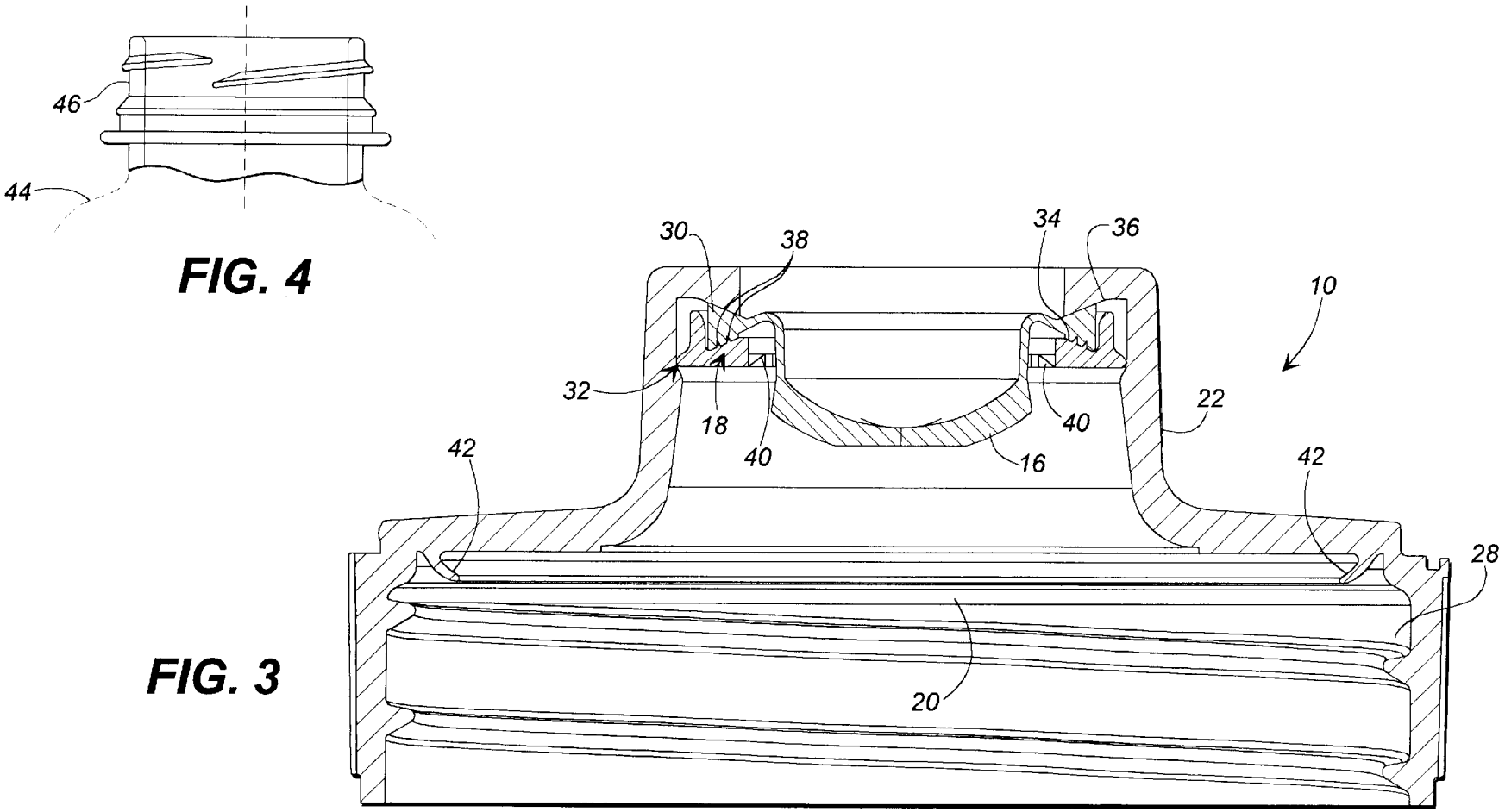
FIG. 3 illustrates a sectional view of a particular embodiment of a dispensing valve closure that accommodates an inner seal, according to the teachings of the present invention.
FIG. 4 illustrates a side view of a typical bottle finish that may be used with particular embodiments of closures according to the teachings of the present invention.

FIG. 3 illustrates a cross sectional side view of dispensing valve closure 10. As shown in FIG. 3, the inside surface of closure body 12 is threaded with threads 28 so as to accommodate a threaded package. However, it should be understood that threads are exemplary only, and that the closure body 12 may engage with the package other than with threads, such as by bonding, or with other techniques or structures.

As shown in FIG. 3, retaining ring 18 supports a marginal flange 30 of self-sealing dispensing valve 16. Retaining ring 18 is held in place by a concentric shoulder 32 formed along the inside surface of boss structure 22. As can be seen in FIG. 3, the retaining ring 18 is formed with a shoulder 34, and the marginal flange 30 is held in place between the retaining ring shoulder 34 and an inside surface 36 of boss structure 22.

To assist in retaining the self-sealing dispensing valve 16, shoulder 34 of the retaining ring 18 may be formed with teeth or ribs 38 as shown in FIG. 3. The structures 38 assist in holding the marginal flange 30, thereby reducing the likelihood that the self-sealing dispensing valve 16 will be dislodged upon the build up of pressure within the package.

Although a retaining ring is shown in the FIGURES, it should be understood that the self-sealing valve 16 may be held in place with any suitable device, such as a cartridge or other retaining device.

Also shown in FIG. 3 are guides 40. These guides, which are also shown in FIG. 1, assist in maintaining the axial orientation of self-sealing dispensing valve 16 with the other components of the dispensing valve closure 10.

FIG. 3 also illustrates the inner seal 20. As shown, the inner seal 20 is placed within the closure body 12, and is adjacent to a package seal 42. As will be discussed, the inner seal 20 seals on the land area of the package after the closure 10 is placed on the package. The package seal 42 provides a seal between the package and the closure body 12 after the inner seal 20 has been removed. The particular package seal 42 shown in FIG. 3 is of the crab claw variety, however other package seals may also be used, such as concentric ribs or other structures.

FIG. 4 illustrates an exemplary package finish which may be used with a dispensing valve closure according to the teachings of the present invention. The particular package finish shown in FIG. 4 is a threaded bottle neck. During the filling process, beverages or food are be filled into the package 44, and then dispensing valve closure 10 is placed upon the finish area 46. The inner seal 20 contacts the land area (or rim) of the finish area 46 to provide the inner seal. "Land area" refers to any such area for sealing. Any suitable inner seal may be used, including induction seals, heat seals, self-adhesive seals, friction seals, any seals providing hermetic or vacuum seals, or any other suitable seal.

In use, the closure body 12 is removed, and the inner seal 20 is then removed from the finish area 46 of the package 44. The closure body 12 is then replaced, and fluid can then be dispensed through the self-sealing dispensing valve 16.

A particular inner seal 20 that may be used is an induction seal, such as those supplied by the Unipak Company of Ontario, Canada. Such seals include, for example, an aluminum layer surrounded by an insulation layer on top and a sealing layer on the bottom. The insulation layer on top provides heat insulation for protecting the package seal 42 from the heat that is used to cause the sealing layer to seal to the finish area 46 of the package. With an induction seal, once the closure body 12 is placed on the package, the package is passed under the induction sealer to induce currents, and therefore heat, within the aluminum layer of the induction seal. This heat causes a bonding between the sealing layer and the bottle finish. The inner seal 20 may incorporate various features to ease removal, such as pull tabs, tri-tabs, or other such devices.

Furthermore, it should be understood that seals that are applied directly to the package, and not carried by the closure, may also be used without departing from the intended scope herein.

Often in the commerical production of beverages, a filled bottle is sprayed with water. For example, this water spraying is provided in a cooling tunnel to cool product that has been hot-filled. Hot filling occurs, for example, at temperatures such as 180° F., in order to destroy microorganisms in the beverage The cooling is typically provided soon after filling, so as to reduce the amount of time that the beverage remains at an elevated temperature, as elevated temperatures can result in off-tastes. Spraying may occur for other reasons as well.

With a hinged closure such as that described above, water (or some other fluid) may build up under the cap 14. This build-up my result from, for example, the cooling spraying described above, or perhaps from condensation or other reasons. The water builds up, in part, if the area around hinge 26 or the seal between cap 14 and closure body 12 is not water-tight.

Figure 7:
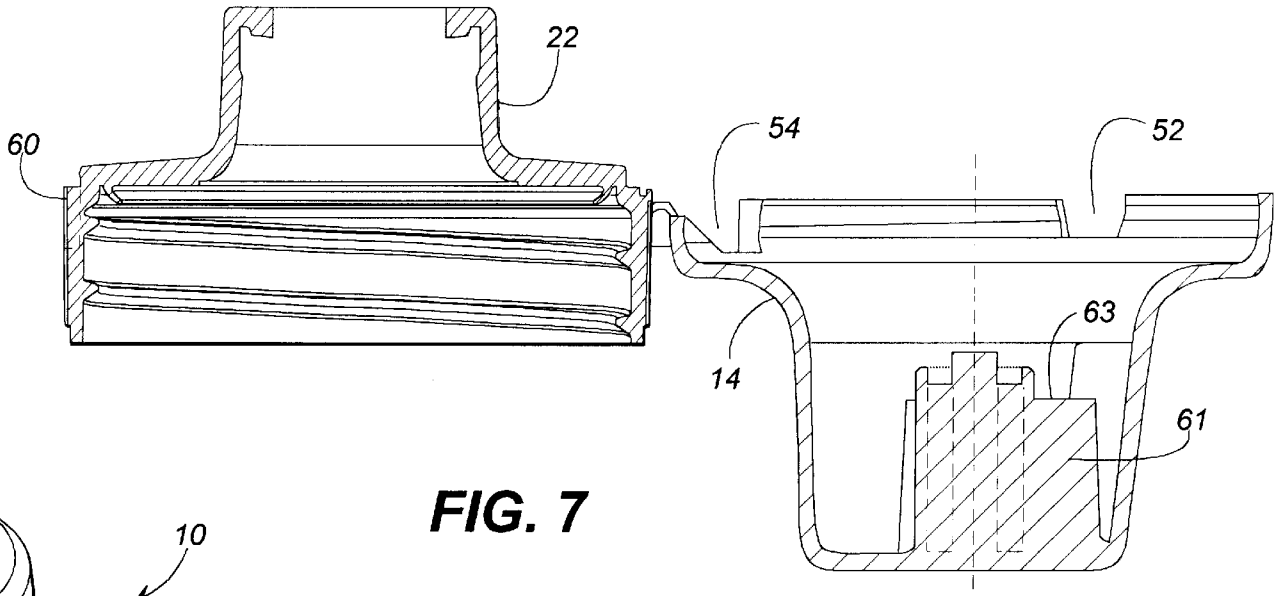
FIG. 7 illustrates a section view based on FIG. 6.
Figure 5:
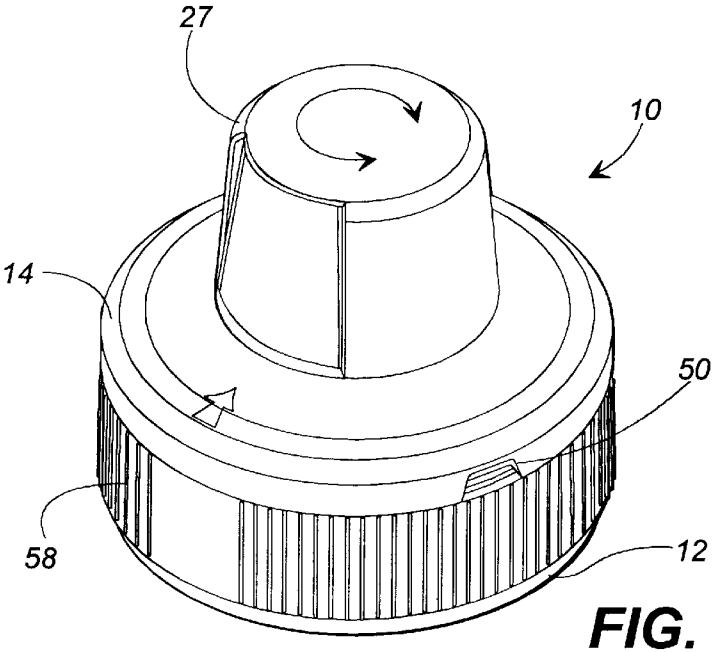
FIG. 5 illustrates an isometric top view of a particular embodiment of the present invention with drain holes.
Figure 6:
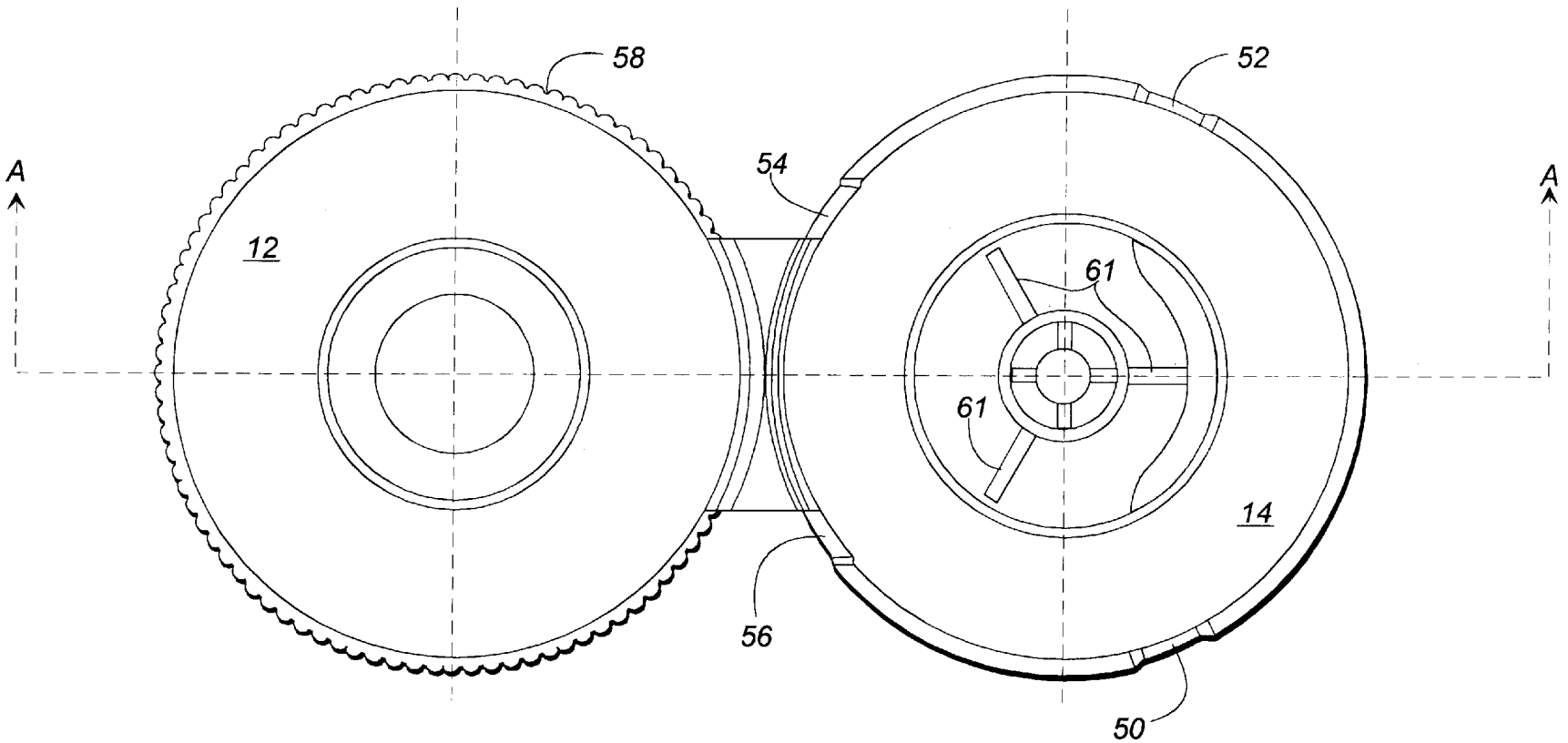
FIG. 6 illustrates a top open view of a particular embodiment of the present invention with drain holes.

To avoid undesirable consequences of such water build up, the closure 10 can be modified to allow for fluid drainage. The removal of any water is important to reduce the likelihood that mold or any other impurities will exist under the cap 14. In particular, as shown in FIGS. 5, 6, and 7, drain holes 50, 52, 54, and 56 are provided in cap 14 so as to allow any fluid build up under cap 14 to drain. The drain holes could also be provided in closure body 12. Although four drain holes are shown in the FIGURES, it should be understood that more or less drain holes may be provided without departing from the intended scope of the present invention.

As shown in FIG. 5, the closure body 12 includes knurls 58. The knurls 58 may be partially removed proximate to the drainage holes 50, 52, 54, or 56, so as to improve the efficiency of drainage from these drain holes. In particular, it may be advantageous to provide such removed areas proximate to holes 54 and 56, which are near the hinge 26. Such a removed area is illustrated by dotted line 60 in FIG. 7. As shown by dotted line 60, part of the surface of closure body 12 can be removed, so as to increase the efficiency of drainage. The removed area 60 shown in FIG. 7 is shown for illustrative purposes only. In practice, the removed area 60 would be aligned with the one or more of the drain holes.

FIGS. 6 and 7 also illustrate webs 61. These webs can be disposed adjacent protrusion 24. As shown in FIG. 7, one or more of the webs 61 include a shoulder 63, which, when the cap 14 is closed, is disposed closely proximate to the surface of boss structure 22. This shoulder 63 prevents the protrusion 24 from penetrating the self sealing dispensing valve if too much downward force is applied to the cap 14 while closed.

Figure 8:
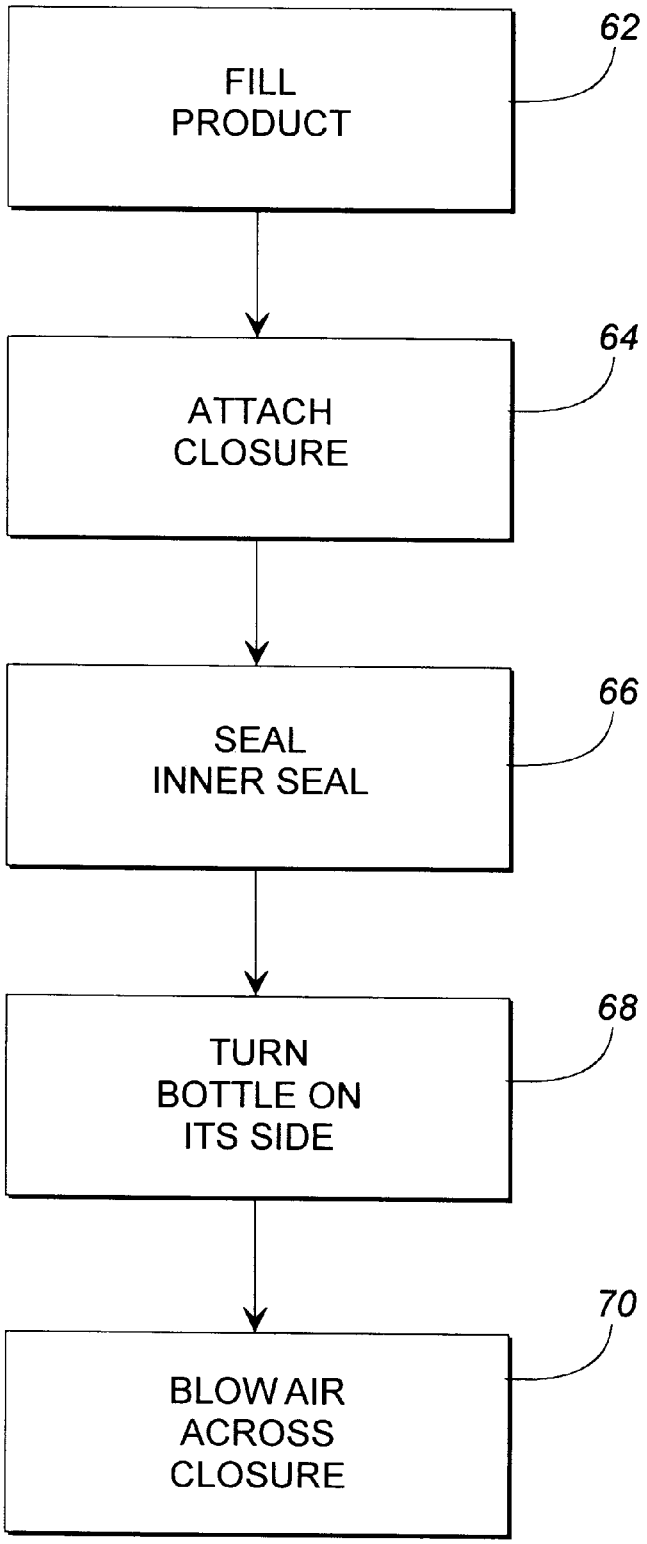
FIG. 8 illustrates a flow chart of a method of sealing containers according to the present invention.

FIG. 8 illustrates a flow chart of a preferred method of removing water that may exist under the cap according to the teachings of the present invention. It should be understood, however, that not all the steps of FIG. 8 are required to remove water according to the present invention.

As shown in FIG. 8, bottles are filled at step 62. Next, a closure according to the present invention is attached to the bottle at step 64, with the inner seal sealed at step 66, if required. As discussed above, the process of sealing the inner seal may comprise induction sealing, among other techniques. Step 66 may be omitted altogether, or may be provided before, during, or after the cooling discussed above.

FIG. 8 next shows step 68 and 70, which may be reversed in order, and step 66 may be performed before, during or after steps 68 and 70. Shown at step 68, the filled bottle with attached closure is turned on its side, so as to allow water to drain out through the drain holes. To assist in turning the bottle on its side, the bottle may be conveyed vertically. Furthermore, the bottle may be axially rotated (see the arrow on FIG. 5) while on its side to increase the efficiency with which water drains.

As shown in step 70, blowers are provided to blow air acrosss the closure. The word "air" is intended to include any gas suitable for drying fluids that may build up under cap 14. This step results in air blowing through the drainage holes, and results in water being forced out of the drainage holes. In a particular embodiment high velocity air blowers can be used. Furthermore, the air blowing can occur before, during, or after the bottle is turned on its side. In particular, it is desirable to have the air blowers blow while the bottle is on its side and rotating.

Although the drain holes and draining methods have been discussed in connection with a closure that includes a self-sealing dispensing valve, it is not necessary that the closure include a self-sealing dispensing valve.

In summary, a self sealing dispensing valve closure is provided which accommodates the use of an inner seal. Furthermore, drain holes are provided to allow water to be removed from under the cap, so as to prevent the build up of mold or other impurities. To assist in drainage, bottles with the closure of the present invention may be turned on their side, and air may be blown across the closure so as to force water out of the drain holes.

Although the present invention has been described in detail, it should be understood that various changes, substitutions, modifications, or alterations may be made without departing from the intended scope herein, as defined by the intended claims.

What is claimed is:

1. A sealing and dispensing device for a package containing a fluid, the package including a land area, comprising:

a closure shaped to engage with the package;

a self-sealing dispensing valve disposed within said closure; and a cap operable to cover said closure, said cap including at least one drain hole to allow drainage of undesirable matter that may exist under said cap.

2. The device of claim 1, and further comprising an inner seal operable to seal on the land area.

3. The device of claim 1, wherein the fluid is a sports drink.

4. The device of claim 1, and further comprising a retaining ring operable to hold said self-sealing dispensing valve within said closure.

5. The device of claim 1, wherein the undesirable matter is water.

6. The device of claim 1, and wherein said cap includes a flip lever.

7. The device of claim 1, wherein said cap includes a protrusion to prevent said self-sealing dispensing valve from opening while said cap is closed.

8. A method of sealing a bottle comprising:

filling a bottle with a fluid;

attaching a closure to the bottle, the closure including at least one drain hole positioned to permit drainage of undesirable matter from within the closure to the outside of the closure and bottle; and turning the bottle on its side so as to allow the undesirable matter to drain through the at least one drain hole and to the outside of the closure and bottle.

9. The method of claim 8, and further comprising sealing an inner seal disposed between the at least one drain hole and the fluid.

10. The method of claim 8, and further comprising providing a self-sealing dispensing valve in the closure.

11. The method of claim 8, and further comprising blowing air across the closure to allow undesirable matter to drain through the at least one drain hole.

12. A method of sealing a bottle comprising:

filling a bottle with a fluid;

attaching a closure to the bottle, the closure including at least one drain hole positioned to permit drainage of undesirable matter from within the closure to the outside of the closure and bottle; and blowing air across the closure to allow the undesirable matter to drain through the at least one drain hole and to the outside of the closure and bottle.

13. The method of claim 12, and further comprising sealing an inner seal disposed between the at least one drain hole and the fluid.

14. The method of claim 12, and further comprising providing a self-sealing dispensing valve in the closure.

15. A method of sealing a bottle comprising:

filling a bottle with a fluid;

attaching a closure to the bottle, the closure including a self sealing dispensing valve therein and at least one drain hole; and turning the bottle on its side so as to allow undesirable matter to drain through the at least one drain hole.

16. The method of claim 15 and further comprising the step of rotating the bottle about its axis while the bottle is on its side to cause the undesirable matter to drain through the at least one drain hole.

17. A method of sealing a bottle comprising:

filling a bottle with a fluid;

attaching a closure to the bottle, the closure including at least one drain hole;

turning the bottle on its side so as to allow undesirable matter to drain through the at least one drain hole; and blowing air across the closure to allow undesirable matter to drain through the at least one drain hole.

18. A method of sealing a bottle comprising:

filling a bottle with a fluid;

attaching a closure to the bottle, the closure including a self sealing dispensing valve therein and at least one drain hole; and blowing air across the closure to allow undesirable matter to drain through the at least one drain hole.

19. The method of claim 18 and further comprising the step of rotating the bottle about its axis to cause the undesirable matter to drain through the at least one drain hole.

20. A method of sealing a bottle, comprising filling a bottle with a fluid;

attaching a closure to the bottle, the closure having a self-sealing dispensing valve therein and at least one drain hole positioned to permit drainage of undesirable matter from within the closure to the outside of the closure and bottle; and rotating the bottle about its axis to cause the undesirable matter to drain through the least one drain hole.

21. A sealing and dispensing device for a package containing a fluid, the package including a land area, comprising a closure shaped to engage the land area of the package, said closure including an elongate tubular boss through which the fluid in the package may be dispensed;

a self-sealing dispensing valve disposed within said boss of said closure; and a cap operable to cover said closure, with one of said cap and said closure including at least one drain hole to allow drainage of undesirable matter that may exist under said cap to the outside of said cap and package.

22. The device of claim 21 wherein said cap includes a peripheral rim, and said at least one drain hole is disposed in said peripheral rim of said cap.

23. The device of claim 21 wherein said cap includes a central dome of a height sufficient to receive the boss of the closure, with said cap being pivotably mounted to said closure for pivotal movement between a covering position wherein the dome encloses the boss and a removed position wherein the boss is exposed and the fluid may be dispensed therethrough.

24. The device of claim 23 wherein said cap includes a protrusion positioned within said central dome to prevent said self-sealing dispensing valve from opening while said cap is in said covering position.

* * * * *